US005713097A

United States Patent [19]

Brown

[11] Patent Number: 5,713,097

[45] Date of Patent: Feb. 3, 1998

[54] BOOT SCRAPER

[76] Inventor: Jaime Brown, 3617 Brayton Ave., Long Beach, Calif. 90807

[21] Appl. No.: 690,674

[22] Filed: Jul. 31, 1996

[51] Int. Cl.[6] ..... A63C 11/18; A43B 5/04; A47L 23/00

[52] U.S. Cl. ..... 15/237; 15/236.08; 36/132; 280/813; D32/47

[58] Field of Search ..... 15/112, 113, 236.01, 15/236.05, 236.06, 236.08, 237, 238; 36/8.1, 132; 280/813; D2/904, 905; D21/228–230; D32/47

[56] References Cited

U.S. PATENT DOCUMENTS

| | | | |
|---|---|---|---|
| D. 340,585 | 10/1993 | Kirk | D4/136 |
| 981,517 | 1/1911 | Andrews | 15/236.08 X |
| 1,258,208 | 3/1918 | Gaillard | 15/236.08 |
| 3,751,832 | 8/1973 | Baryluk | 15/112 X |
| 3,811,207 | 5/1974 | Peis | 15/112 X |
| 3,929,345 | 12/1975 | Nasby | 280/813 |
| 4,617,696 | 10/1986 | Meta | 15/236.08 |
| 4,900,061 | 2/1990 | Kozma, Jr. | 280/813 |
| 5,042,839 | 8/1991 | Ciari | 280/813 |
| 5,077,858 | 1/1992 | Lewis, Jr. | 15/161 |

FOREIGN PATENT DOCUMENTS

| | | | |
|---|---|---|---|
| 2702233 | 7/1978 | Germany | 15/237 |

*Primary Examiner*—Mark Spisich
*Attorney, Agent, or Firm*—Hecker & Harriman

[57] ABSTRACT

A boot scraper of novel design and shape and incorporating a novel boot scraping surface that can be mounted to, or incorporated in, skiing implements such as skis and snowboards, as well as ski boot bindings, snowboard boot bindings, and ski boots and snowboard boots. In one embodiment, the boot scraper comprises an elongated polygonal molded rigid ABS plastic block that is mounted to the top surface of a ski. The block is mounted to the ski by an adhesive or by mechanical fasteners such as screws. The top surface of the boot scraper incorporates a two-dimensional grid of adjacent polyhedrons extending in an upward direction. The tips of the polyhedrons form a scraping surface consisting of a multi-dimensional array of spaced, generally rigid pointed surfaces. The underside of the block contains hollowed out cavities that reduce weight but maintain strength and rigidity of the block. The scraper is used by drawing the sole of the ski boot to be cleaned over the scraper. The array of pointed surfaces forming the scraping surface quickly and omnidirectionally removes snow and foreign matter from the bottom of the boot.

2 Claims, 5 Drawing Sheets

BOOT SCRAPER

BACKGROUND OF THE INVENTION

1. Field of the Invention

The present invention relates generally to snow skiing implements such as snowboards and snow skis, and more particularly to an improved boot scraper of novel design and shape and incorporating a novel boot scraping surface for cleaning the undersurfaces of ski and snowboard boots.

2. Background Art

Accumulated snow and other foreign matter on the undersides of ski and snowboard boots prevents proper seating of the boots in ski boot and snowboard boot bindings. Improperly seated boots may lead to premature binding release and loss of control. Accordingly, it is important that snow and other foreign matter be removed from the undersurfaces of ski and snowboard boots prior to mounting the boots in ski and snowboard boot bindings.

Cleaning snow off the undersides of ski and snowboard boots prior to putting on skis or snowboards is usually awkward and inconvenient, especially if a ski or snowboard has become loose after a fall and the skier or snowboarder is attempting to remount the ski or snowboard. Skiers are forced to balance on one ski and one ski pole, using the other pole to clean the bottom of the loose boot while simultaneously balancing on the snow covered slope and retaining the loose ski in a position that will allow the loose boot to be inserted in the binding. Snowboarders have similar problems.

Prior art attempts at ski boot sole cleaning devices have included ski-mounted scraping devices such as those disclosed in U.S. Pat. Nos. 3,826,518, 3,975,036, 3,976,304, 3,999,773, 5,156,418, 5,147,098 and Des. 305,270, and ski pole-mounted scraping devices such as those disclosed in U.S. Pat. Nos. 4,000,909, 4,145,063 and 5,358,277. These prior art cleaning devices have been excessively complex and/or expensive, have interfered with the operation of the skis, have not been robust enough to hold up to the rigors of skiing use, have been awkward to use, or were otherwise unsatisfactory. Accordingly there remains a need for an effective boot underside cleaning device that is robust, effective, non-intrusive, easy to use and inexpensive to make.

SUMMARY OF THE INVENTION

The present invention consists of a boot scraper of novel design and shape and incorporating a novel boot scraping surface that can be mounted to, or incorporated in, skiing implements such as skis and snowboards, as well as ski boot bindings, snowboard boot bindings, and ski boots and snowboard boots. In one embodiment, the boot scraper of the present invention comprises an elongated polygonal molded rigid ABS plastic block that is mounted to the top surface of a ski. The block is mounted to the ski by an adhesive or by mechanical means such as screws. The top surface of the boot scraper incorporates a two-dimensional grouping of adjacent polyhedrons extending in an upward direction. Each polyhedron generally has a quadrilateral base and a pointed tip. The tips of the polyhedrons form a scraping surface consisting of a multi-dimensional array of spaced, generally rigid pointed surfaces. The underside of the block contains hollowed out cavities that reduce weight but maintain strength and rigidity of the block. The scraper is used by drawing the sole of the ski boot to be cleaned over the scraper. The array of pointed surfaces forming the scraping surface quickly and omnidirectionally removes snow and foreign matter from the bottom of the boot. The scraper may be molded in a variety of colors so as to be decorative as well as utilitarian. The scraper may also be fabricated using a variety of plastics or other light weight materials, such as composites or metals. Another embodiment of the invention, intended for mounting on snowboards, comprises a polygonal cylinder with polyhedral projections extending from portions of the cylinder's exterior surfaces, forming a scraping surface consisting of a generally semi-cylindrical array of pointed surfaces.

DETAILED DESCRIPTION OF THE INVENTION

A boot scraper incorporating a novel boot scraping surface is disclosed. In the following description, numerous specific details such as dimensions, materials, shapes, mounting methods, etc. are described in detail in order to provide a thorough description of the present invention. It will be apparent to one skilled in the art, however, that the invention may be practiced without these specific details. In other instances, well-known features have not been described in detail so as not to obscure the present invention unneccessarily.

FIGS. 1–5 are top, side, front, back, and perspective views, respectively, of one embodiment of the present invention. This embodiment consists of a boot scraper that is intended to be mounted on the top surface of a ski, typically in front of the toe plate or behind the heel plate of a ski boot binding. This embodiment may be molded from a durable plastic material that is able to withstand freezing temperatures without becoming brittle, that is impact and abrasion resistant, that does not absorb water, that exhibits low thermal expansion, and that exhibits good color retention under long term exposure to sunlight. Plastic materials that may be used include ABS, polypropelene, and formion. The plastics used may have a variety of decorative colors. Logos, trademarks or other graphics or text may be imprinted on or molded into the boot scraper as desired.

Figure 1:
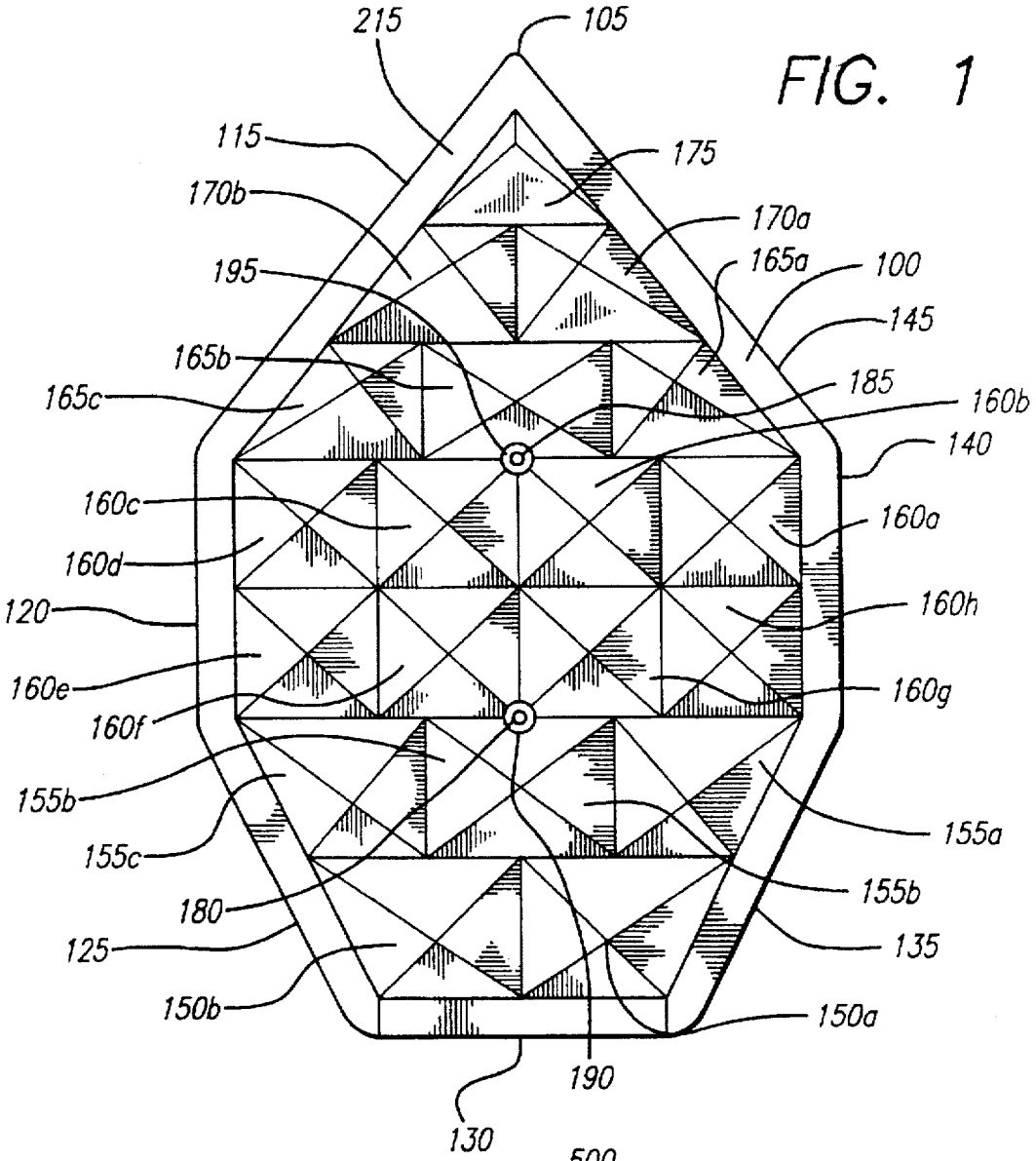
FIG. 1 is a top view of one embodiment of a boot scraper of the present invention.
Figure 5:
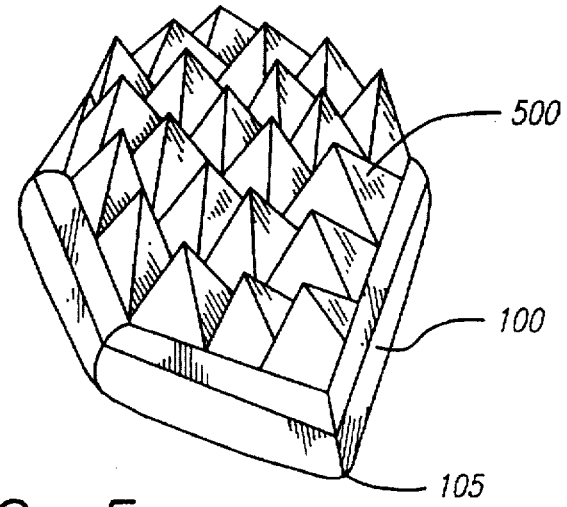
FIG. 5 is a perspective view of the embodiment of FIG. 1.

As shown in FIGS. 1 and 5, boot scraper 100 of this embodiment has a plan shape generally in the form of a polygon. As shown more clearly in FIG. 1, in this embodiment the polygon is an irregular heptagon with a front vertex 105 and sides 115, 120, 125, 130, 135, 140, and 145, respectively. When mounted to a ski, boot scraper 100 is typically oriented such that front vertex 105 points to the front tip of the ski. Front vertex 105 and sides 115 and 145 of boot scraper 100 present a wedge-shaped profile towards the front of the ski, reducing air and snow resistance of boot scraper 100 and aiding the shedding of snow from the ski forward of the location at which boot scraper 100 is mounted. In this embodiment, the overall length of boot scraper 100 from front vertex 105 to rear side 130 is approximately 3 ½ in. The width between sides 120 and 140 is approximately 2 ½ in.

As shown in FIG. 5, the top surface of boot scraper 100 features a two-dimensional grouping of adjacent polyhedral projections 500. These projections are identified individually in FIG. 1 as projections 150*a*, 150*b*, 155*a*, 155*b*, 155*c*, 160*a*, 160*b*, 160*c*, 160*d*, 160*e*, 160*f*, 160*g*, 160*h*, 165*a*, 165*b*, 165*c*, 170*a*, 170*b*, and 175, respectively. As shown in FIG. 1, the bases of these projections, except for front projection 175, are quadrilaterals.

The projections can be divided into three groups: front projections 165*a–c*, 170*a–b*, and 175; central projections 160*a–h*; and rear projections 150*a–b* and 155*a–c*.

The bases of central projections 160*a–h*are squares with approximately ½ in. long sides. The height of projections 160*a–h* is approximately ⅝ in. above the plane 210 shown in FIG. 2. Projections 160*a*–160*h*form a set of eight adjacent pyramid shaped projections arranged in two rows of eight projections each.

The first row of front projections immediately adjacent to central projections 160*a–d* consists of three projections 165*a–c*, respectively. Middle projection 165*b*has a rectangular base approximately ½ in. deep and ⅝ in. wide. Right and left projections 165*a* and 165*c* are mirror images of each other. Each has a rhombus shaped base approximately ½ in. deep, 11/16 in. wide on the side adjacent to center projections 160*a–d*, and 5/16 in. wide on the opposite side.

The next row of front projections consists of two projections 170*a–b*. Right and left projections 170*a–b* are mirror images of each other. Each has a rhombus shaped base approximately ½ in. deep, ¾ in. wide on the side adjacent to projections 165*a–c*, and ⅜ in. wide on the opposite side.

The final row of front projections consists of a single projection 175. Projection 175 has a triangular base approximately ½ in. deep and ¾ in. wide.

The first row of rear projections immediately adjacent to central projections 160*e–h* Consists of three projections 155*a–c*, respectively. Middle projection 155*b*has a rectangular base approximately ½ in. deep and ⅝ in. wide. Right and left projections 155*a* and 155*c* are mirror images of each other. Each has a rhombus shaped base approximately ½ in. deep, 11/16 in. wide on the side adjacent to center projections 160*e–h*, and ½ in. wide on the opposite side.

The second row projections consists of two projections 150 *a–b*. Right and left projections 150*a–b* are mirror images of each other. Each has a rhombus shaped base approximately ½ in. deep, 11/16 in. wide on the side adjacent to projections 155*a–c*, and ½ in. wide on the opposite side.

Figure 2:
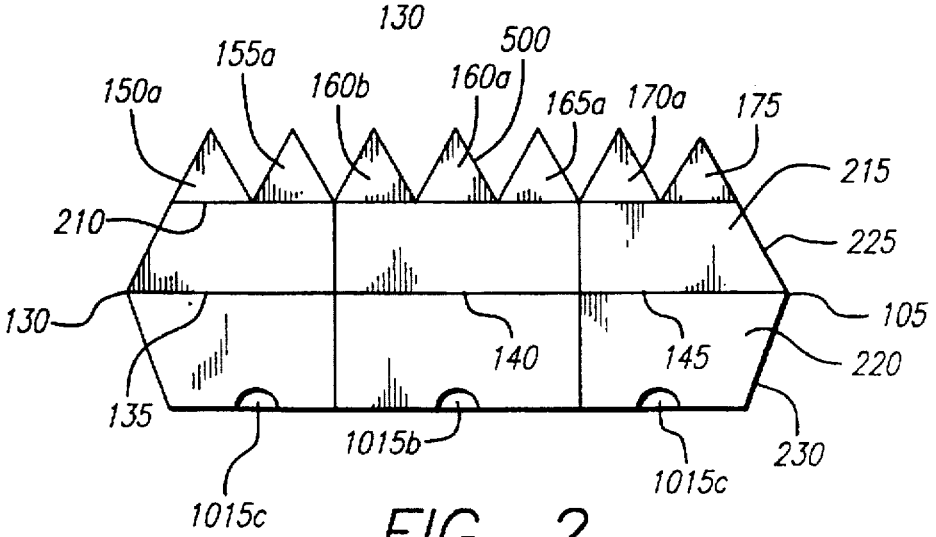
FIG. 2 is a side view of the embodiment of FIG. 1.
Figure 3:
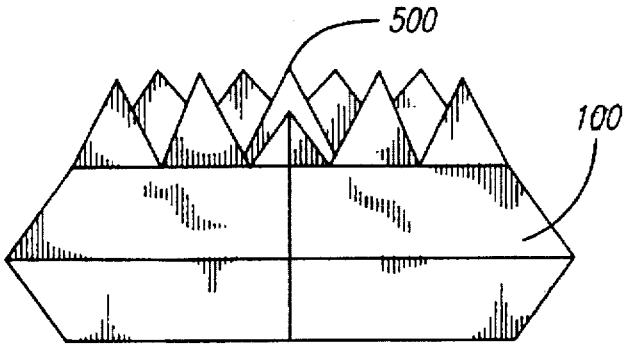
FIG. 3 is a front view of the embodiment of FIG. 1.
Figure 4:
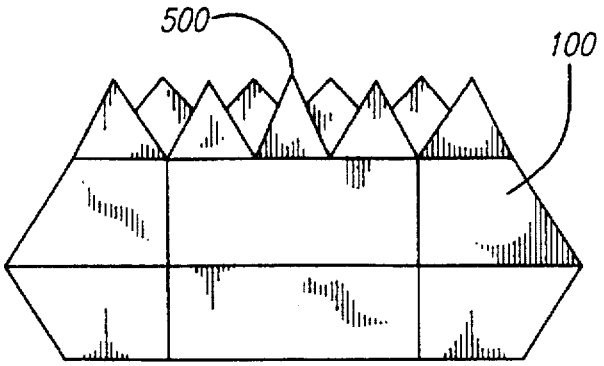
FIG. 4 is a back view of the embodiment of FIG. 1.

Like central projections 160*a–h*, each of projections 150*a–b*, 155*a–c*, 165*a–c* and 170 *a–b* forms a generally pyramid shaped projection approximately the same ⅝ in. high. In this embodiment, as shown in FIG. 2, front projection 175, though also pyramid shaped, is somewhat smaller than the other projections, having a height of approximately ⅜ in. The tips of the projections are rounded off to provide additional strength.

As shown in FIG. 2, below projections 500, boot scraper 100 consists of a midsection 215 and a bottom section 220.

Midsection 215 is also visible in FIG. 1. As shown in FIGS. 1 and 2, midsection 215 has a beveled edge 225 that extends from the heptagon formed by the bases of projections 500 to the heptagon formed by the outside edges 115, 120, 125, 130, 135, 140 and 145. In this embodiment, midsection 215 is approximately 5/16 in. high, and beveled edge 225 extends approximately ¼ in. outwardly from the heptagon formed by the bases of projections 500.

Figure 10:
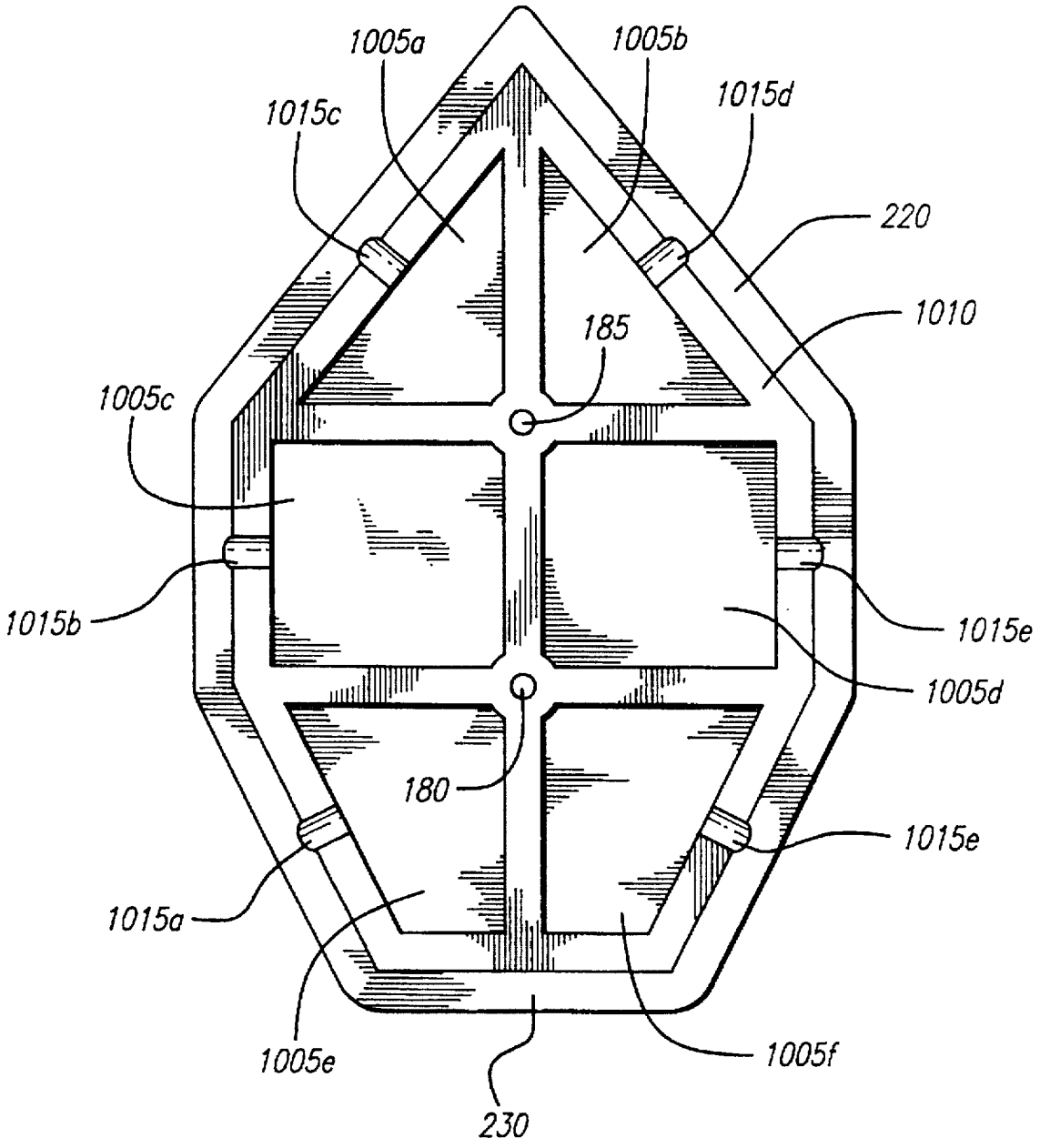
FIG. 10 is a bottom view of the embodiment of FIG. 1.

Bottom section 220, visible in FIG. 10 as well as in FIG. 2, is a mirror image of midsection 215, having a beveled edge 230 that extends inwardly from the heptagon formed by the outside edges 115, 120, 125, 130, 135, 140 and 145 to a approximately equal in size to the heptagon formed by the bases of projections 500. In this embodiment, bottom section 220 is approximately 5/16 in. high, and beveled edge 230 extends approximately ¼ in. inwardly from the heptagon formed by outside edges 115, 120, 125, 130, 135, 140 and 145.

In another embodiment of boot scraper 100, the front diagonal sides 115 and 145 of mid section 215 and bottom section 220 are not beveled but are vertical. The other sides remain beveled as above. The vertical sides can be used to imprint a logo or tradename onto boot scraper 100.

The embodiment of boot scraper 100 shown in FIG. 1 includes mounting holes 180 and 185 and recessed shoulders 190 and 195. Mounting holes 180 and 185 extend through the bottom of boot scraper 100. Recessed shoulders 190 and 195 extend below the bases of projections 500. In this embodiment, mounting holes 180 and 185 are approximately ⅛ in. in diameter and spaced one inch apart, while recessed shoulders 190 and 195 are approximately 3/16 in. in diameter.

Mounting holes 180 and 185 can be used to mount boot scraper 100 to the top surface of a ski. In one embodiment, stainless steel threaded inserts are installed in the ski at positions corresponding to the position of mounting holes 180 and 185 when boot scraper 100 is located at the desired mounting location. Boot scraper 100 is placed in the desired location, and fastened to the top surface of the ski by means of stainless steel screws inserted through mounting holes 180 and 185 and screwed into the threaded inserts that have been installed in the ski. In one embodiment, 8–15×11/16 in. Philips pan head stainless steel passivated 18–8 screws are used.

Boot scraper 100 may also be adhesively fastened to the top of a ski, or any of a variety of other well known mechanical and/or adhesive fastening means may be used.

To save weight while maintaining structural integrity, a number of cavities may be formed in the bottom of boot scraper 100 as shown in FIG. 10. Cavities 1005*a–f* shown in FIG. 10 are approximately ⅝ in. deep and are dimensioned and shaped so that a web 1010 approximately 3/16 in. thick remains around the edges of the base of boot scraper 100, around mounting holes 180 and 185, and across the inside of boot scraper 100 as shown in FIG. 10. In addition, drainage openings 1015*a–f*, shown in FIG. 10 and also in FIG. 2, may be formed through web 1010 along the bottom edge of bottom section 220 of boot scraper 100 so as to allow water formed by melting snow and ice to drain out from cavities 1005*a–f*.

Figure 6:
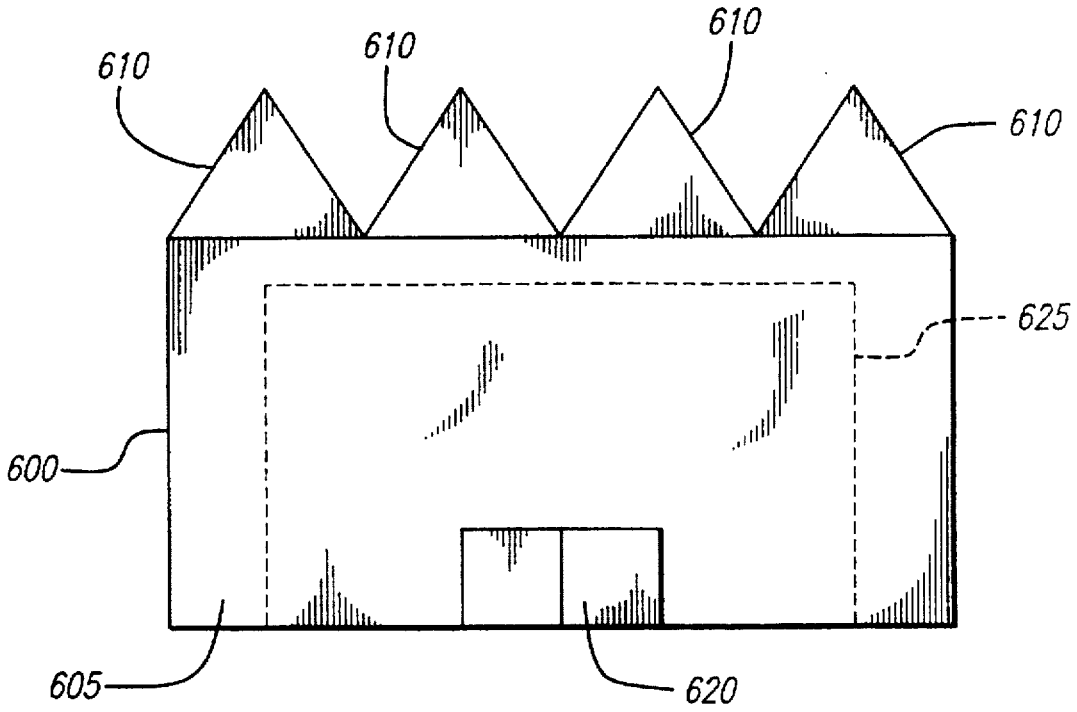
FIG. 6 is a side view of a second embodiment of a boot scraper of the present invention.
Figure 7:
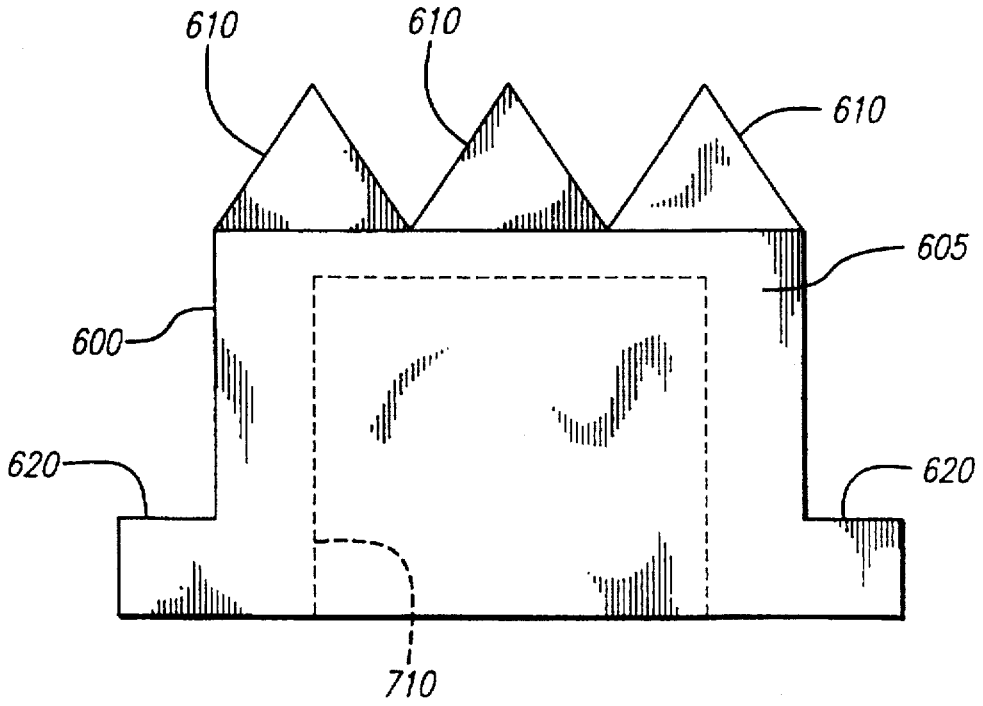
FIG. 7 is a front view of the embodiment of FIG. 6.
Figure 8:
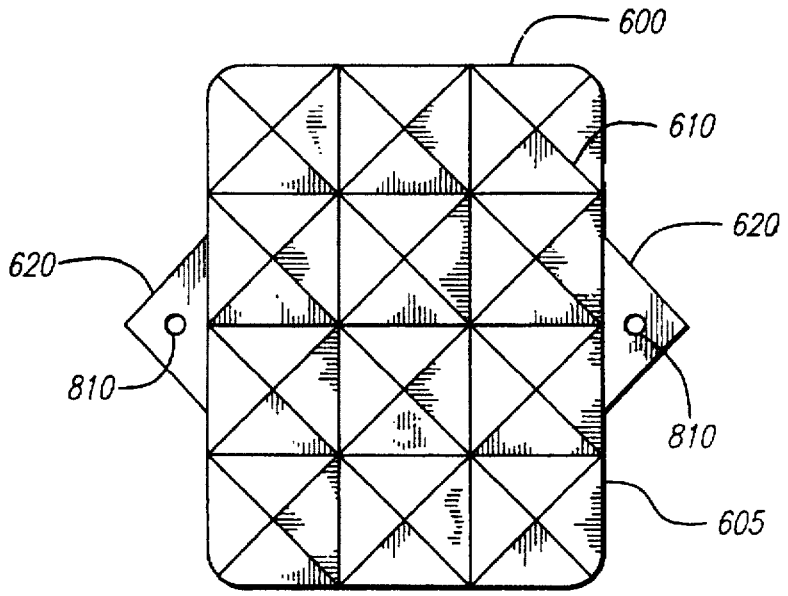
FIG. 8 is a top view of the embodiment of FIG. 6.

A second embodiment of the boot scraper of the present invention is shown in FIGS. 6–8. In this embodiment, as shown in FIGS. 6–8, boot scraper 600 consists of a molded rectangular block 605 with a three-by-four grid of polyhedral projections 610 extending from its top surface and two triangular mounting flanges 620 extending from its base. In this embodiment, projections 610 are approximately equal to each other in size and shape, having a generally square base and symmetrical sides such that each projection 610 is in the form of a four-sided pyramid. The base of each projection 610 is approximately 9/16 by 9/16 in. in size, and the height of each projection 610 is approximately ¾ in. Mounting flanges 620 are approximately ⅛ in. thick, are approximately ¾ in. wide at their base, and extend approximately ⅛ in. outwardly from rectangular block 605. Each mounting flange 620 contains a mounting hole 810 through which a screw can be inserted to mount boot scraper 600 to the top surface of a ski. Boot scraper 600 may also contain a hollowed-out inside cavity, the outline of which is indicated by dotted line 625 in FIG. 6 and 710 in FIG. 7.

Figure 9:
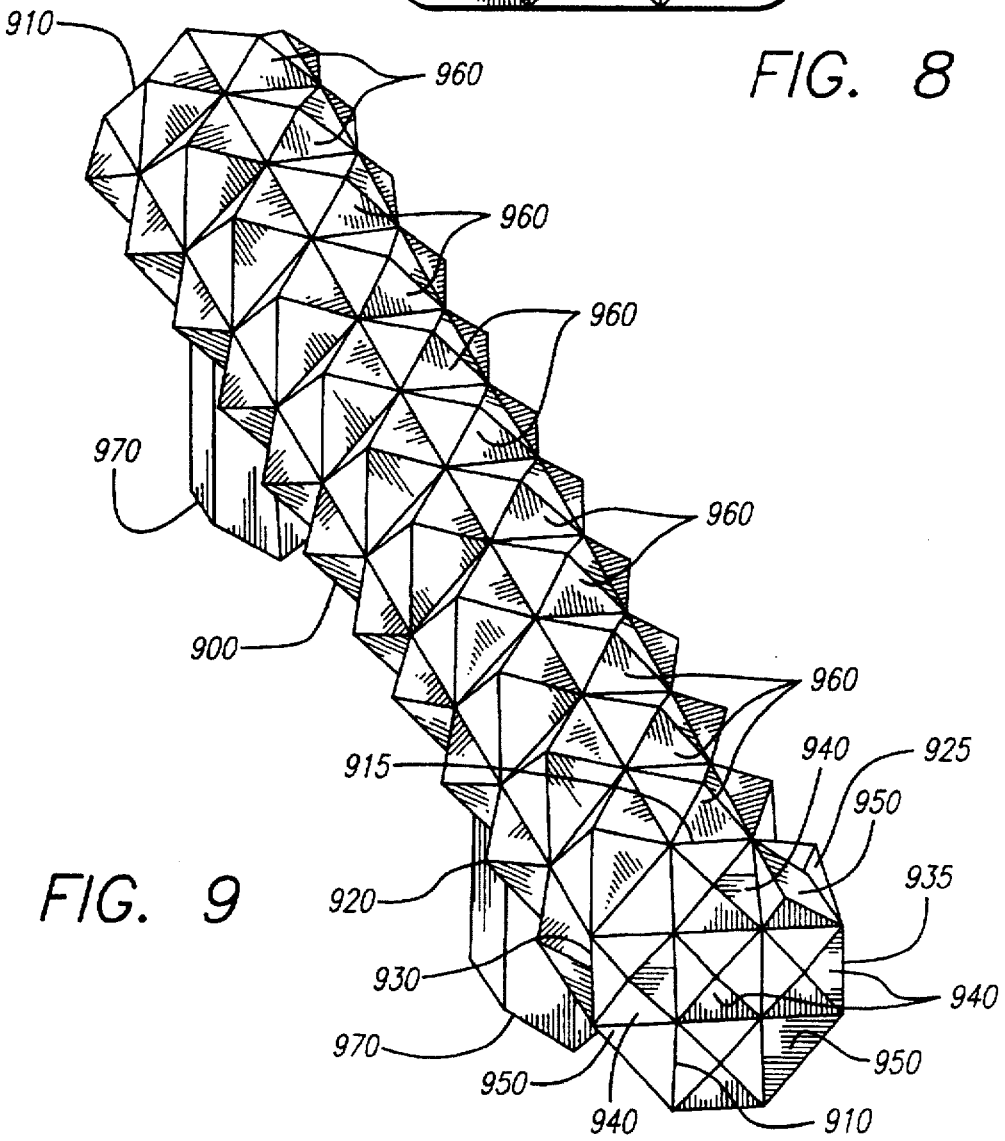
FIG. 9 is a perspective view of a third embodiment of a boot scraper of the present invention.

An embodiment of the present invention intended for mounting on snowboards is shown in FIG. 9. Because a snowboard is much wider than a ski, a wider boot scraper can be used with a snowboard than with a ski, providing a larger scraping surface. In addition, because only a single board is used in snowboarding, a snow scraper for a snowboard may project a substantial distance above the snowboard surface without interfering with the operation of the snowboard.

In the embodiment shown in FIG. 9, boot scraper 900 has the form of an elongated octagonal prism containing polyhedral projections on each of its end faces 910 and along its exposed longitudinal sides, which in this embodiment are upper horizontal side 915, upper diagonal sides 920 and 925, and vertical sides 930 and 935.

Each face 910 contains nine polyhedral projections: five full projections 940 and four half projections 950. Each full projection 940 has an approximately square base with sides of length approximately between ⅛ and ¾ in. Each projection 940 is approximately ½ to ¾ in. high. Each half projection 950 is approximately equal in size to a full projection 940 that has been bisected diagonally across its square base.

Each of the exposed longitudinal sides, such as upper horizontal side 915, contains a row of adjacent polyhedral projections 960 approximately equal in size to full projections 940. In the embodiment shown in FIG. 9, there are eleven projections 960 along a side.

Boot scraper 600 is mounted to the top surface of a snowboard by means of polygonal mounting blocks 970 that extend downwards from boot scraper 900. In the embodiment shown in FIG. 9, mounting blocks 970 are generally hexagonal and extend downwards approximately ½ to 1 in. The mounting blocks may be adhesively affixed to the snowboard, or any of a variety of other well known fastening means may be used.

Boot scraper 900 may be transversely mounted on the snowboard in front of or behind the snowboard's boot bindings. To use boot scraper 900, a snowboarder draws the underside of a snowboard boot in any direction across boot scraper 900 such that it engages any portion of the multifaceted, three dimensional snow scraping surface formed by the tops of the polyhedral projections of boot scraper 900. Because boot scraper 900 features scraping surfaces oriented at a variety of angles all around its exposed surfaces, effective cleaning of a snowboard boot underside can be achieved at a variety of boot orientations with respect to boot scraper 900.

In other embodiments, the snow scraping surface of the present invention, comprising a two or three dimensional groupings of spaced, rigid pointed surfaces formed by the tips of two and three dimensional arrays of projections, are directly incorporated in a ski or, snowboard surface, a boot, or a binding, or are incorporated in boot scrapers designed to be mounted to ski and snowboard boots and bindings. In one example embodiment, a scraping surface comprising an array of polyhedral projections similar to the array extending from the top surface of boot scraper 100 of FIG. 1 is integrally formed with the top surface of a ski. In another embodiment, an array of such projections is integrally formed on an exposed surface of a ski or snowboard boot, for example adjacent to the heel, the toe, or the side of the boot. In a further embodiment, the scraping surface of the present invention is incorporated in the heel or toe plate of a ski boot binding, or in a separate boot scraper designed to be mounted on the heel and/or toe plate of the ski boot binding.

Thus, a boot scraper incorporating a novel boot scraping surface has been presented. Although the invention has been described with respect certain detailed embodiments, the invention is not limited to the specific embodiments and details presented. For example, the projections forming the scraping surface of the present invention have been described as polyhedrals. However, other projections, for example conical projections, may be used. The boot scrapers of the present invention have been described as being formed of plastic. However, other materials, including, without limitation, aluminum and other metals, ceramics, or composite materials may be used. The boot scraper of the present invention may have any of a variety of shapes and forms, and the projections forming the scraping surface may be arranged in a variety of configurations. For example, the projections may be arranged around the perimeters of concentric circles. Other variations of the present invention will be evident to those skilled in the art.

I claim:

1. A boot scraper for removing snow and other foreign matter from the undersides of boots comprising:

a first surface;

a plurality of projections each terminating at a tip extending from said first surface;

a scraping surface comprising said tips of said projections;

wherein said first surface comprises a plurality of planar surfaces, said plurality of planar surfaces comprising surfaces of a longitudinal polygonal cylinder.

2. A boot scraper for removing snow and other foreign matter from the undersides of boots comprising:

a mounting block comprising a first surface, said first surface comprising a planar polygon, said planar polygon including a pair of angled sides which cooperate to define a vertex at an end of said block;

a plurality of projections each terminating at a tip extending from said first surface;

a scraping surface comprising said tips of said projections;

means to secure said mounting block to a skiing implement such that said vertex of said planar polygon may be positioned to extend towards a front tip of said skiing implement when mounted thereon.

* * * * *